United States Patent [19]

Miller

[11] 4,046,448

[45] Sept. 6, 1977

[54] LIGHTING FIXTURE ACCESSORY

[76] Inventor: Keith G. Miller, 88 Carroll St., Binghamton, N.Y. 13902

[21] Appl. No.: 631,194

[22] Filed: Nov. 11, 1975

Related U.S. Application Data

[63] Continuation-in-part of Ser. No. 497,654, Aug. 15, 1974.

[51] Int. Cl.[2] ..... F21V 21/12; F21V 21/22

[52] U.S. Cl. ..... 339/153; 240/67; 339/6 R; 339/154 L

[58] Field of Search ..... 240/67, 68, 70; 339/153, 154 A, 154 L, 1 L, 6 R, 9 R, 25, 119 L, 176 L, 182 L

[56] References Cited

U.S. PATENT DOCUMENTS

| | | | |
|---|---|---|---|
| 825,182 | 7/1906 | Bonnella | 339/154 L X |
| 1,145,383 | 7/1915 | McWilliams | 339/9 R |
| 3,400,359 | 9/1968 | Bedini | 339/154 L X |

*Primary Examiner*—Roy Lake
*Assistant Examiner*—E. F. Desmond
*Attorney, Agent, or Firm*—Frederick E. Bartholy

[57] ABSTRACT

An accessory device for lighting fixtures is described. It comprises a pair of telescoping tubular housings having at one end a standard screw terminal adapted to fit a conventional electric socket and, at the other end, a standard electric lamp socket. Electrically conductive connections are provided within the housings for interconnecting the end terminals at any position of extension of the housings.

2 Claims, 4 Drawing Figures

LIGHTING FIXTURE ACCESSORY

This is a continuation-in-part of my copending application Ser. No. 497,654 filed Aug. 15, 1974.

This invention relates to lighting fixtures and, more particularly, to an accessory device whereby conventional electric sockets accommodating a light bulb may be utilized to convert them into a fixture extensible to various desired lengths.

Extensible fixtures have been known in the prior art devices, depending mostly on coiling of the cord when the fixture is compressed.

Representative of these are U.S. Pat. Nos. 2,115,898 and 2,636,112. Sliding contact arrangements have been proposed in U.S. Pat. Nos. 1,039,556 and 1,607,807. Such contacts depend on spring pressure against a metallic surface. These have a serious drawback due to sparking and oxidation as well as softening of the spring element.

It is to be noted that none of the prior art devices is capable of interconnection of one with the other to make any desired length of a telescopically workably fixture.

It is a particular feature of the invention that the device, when inserted at one end into a light socket, extends the latter and offers, at the other end, a socket terminal similar to the one into which it was inserted.

It is a particular object of the invention to provide an accessory device which enables the user to transform simple light sockets into fixtures extendable in length.

It is a particular advantage of the invention that the accessory device is simple in construction and easy to operate. Also one unit may be connected to another to make any desired length.

Other objects, features and advantages will be apparent from the following description of the invention, defined in particularity in the appended claims, and taken in connection with the accompanying drawing, in which:

Figure 1:
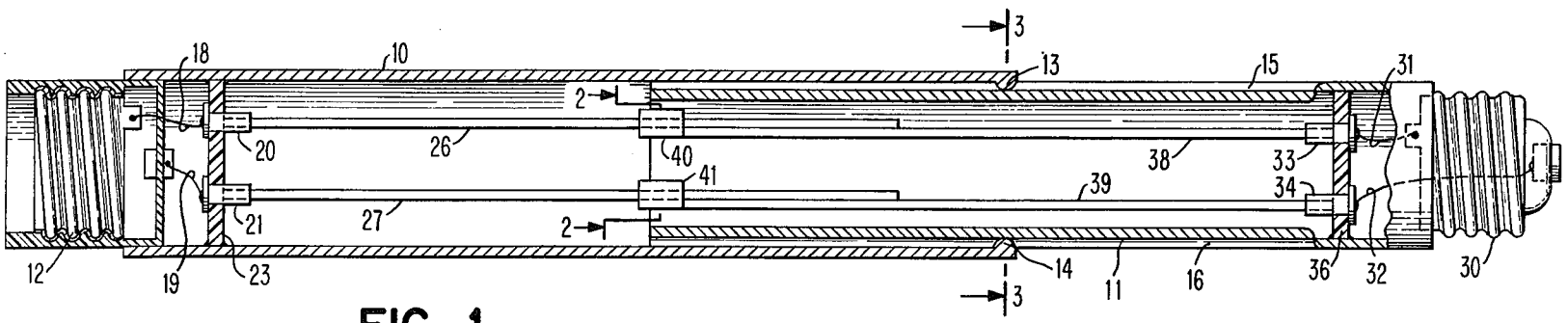
FIG. 1 is a cross-sectional view of the accessory device.

Referring to the drawing, in FIG. 1 it is seen that the device comprises two tubular housings 10 and 11, of which the former has a larger diameter so that it may fit over the latter, whereby the two housings may be telescopically moved inwardly or outwardly as the case may be.

Figure 4:
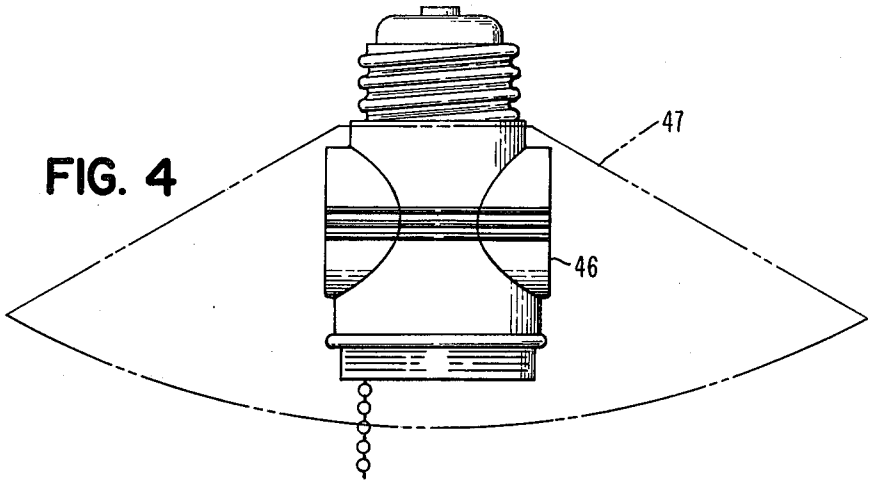
FIG. 4 is a pictorial representation of a standard lamp socket of the pull chain type which may be used in connection with the accessory device of FIG. 1.

Solidly inserted at one end of the housing 10 is a standard socket 12 which accommodates a light bulb or any similar electric appliance, for example, a pull chain socket as shown in FIG. 4.

At the other end, the tubular housing 10 has a pair of inwardly extending lips 13 and 14 which engage corresponding channels or grooves 15 and 16 in the side of the housing 11. The purpose of these will be apparent from the description of the operation of the device. One end of the housing 10 is fitted with a socket 12 which is electrically connected by flexible wires 18 and 19 to bushings 20 and 21, respectively. The latter are mounted in an insulating support 23 which may be in the form of a disc wedged into the housing 10.

Extending from the bushing 20 is a conductive bar 26 and extending from bushing 21 is a similar bar 27, both running parallel to the wall of the housing 10 and of a length approximately that of the housing.

The inner tubular housing 11 is fitted with a male plug 30 of the type which may be screwed into an electric socket in the same manner as an electric bulb. The plug 30 is connected by flexible wires 31 and 32 to bushings 33 and 34, respectively. The latter are mounted in an insulating support 36 which may have the form of a disc wedged into the housing 11.

Figure 3:
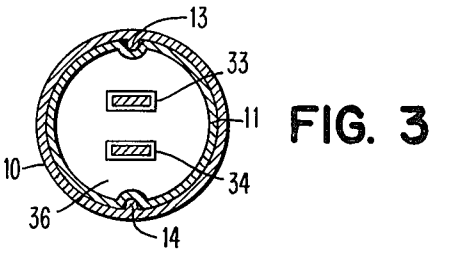
FIG. 3 is a sectional view taken along line 3—3 of FIG. 1.
Figure 2:
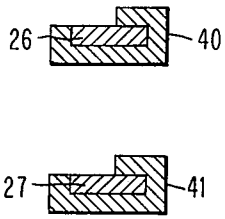
FIG. 2 is a sectional view taken along line 2—2 of FIG. 1.

A conductive bar 38 extends from the busing 33 and a similar bar 39 extends from the bushing 34 in a cantilever manner. Both bars run parallel to the housing 11 and each terminates in a fold-over sleeve which provides a sliding contact with the particular bar. For example, sleeve 40 contacts the bar 26 and sleeve 41 contacts the bar 27, as shown in FIG. 2. This contact is solid, in the form of a clamp which provides contact not only on both sides of the bars 26 and 27, but also on the edges thereof. It is readily seen that as the housing 10 and 11 are separated or pushed together, sliding contact is maintained between the conductive bars so that the end terminals, namely, the socket 12 and the plug 30, remain in firm electrical contact.

It will be obvious, of course, that the housings 10 and 11 may be made in various lengths. These may also be interconnected to obtain any desired length which may be necessary to extend a particular electric light socket or terminal.

This is extremely useful where high ceilings are concerned, as, for example, in churches. Such devices also serve a very practical purpose where quick adjustable electrical assemblies are needed during erection of a building.

The operation of the device is extremely simple. Light sockets, particularly those located on the ceiling of a room, may easily be converted into fixtures the length of which can be extended by the user. The device is simply screwed into an available socket in the same manner as a bulb would be. This can be effected by virtue of the fact the realtive rotary motion between the housings 10 and 11 is prevented by the lips 13 and 14 engaging the grooves 15 and 16. Consequently, when the housing 10 is turned by hand, the housing 11 must also follow. In this manner, the device can easily be inserted in a light socket and made fast therein. At the other end, an electric bulb or pull chain socket 46, as seen in FIG. 4, may be inserted. The socket 46 may of course have any desired shade 47, shown in outline merely by way of example. Thus a simple electric light socket located above is converted into a fixture which may be extended in length by simply pushing the bottom portion so that it telescopes into the top portion in order to make it shorter, or by pulling down to make the fixture longer. The electrical connections are not disturbed by virtue of the sliding bar arrangement within the housings.

The invention in its broader aspects is not limited to the specific embodiments herein shown and described but changes may be made within the scope of the accompanying claims without departing from the principles of the invention and without sacrificing its chief advantages.

What is claimed is:

1. A lighting fixture accessory device extensible to various lengths comprising:

an inner tubular housing and an outer tubular housing of predetermined length, said inner tubular housing being of such diameter as to telescopingly fit within said outer housing, said outer housing terminating at a first end in at least two spaced, inwardly extending lips, said lips being slidably retained in at least two grooves extending longitudinally from a first end of said inner housing, along a portion of said inner housing, said lips and grooves cooperating to prevent relative rotation of said inner and outer housings during telescoping movement thereof;

an outwardly extending threaded standard male fitting adapted to fit a standard electrical receptacle extending from a second end of one of said tubular housings;

a standard female threaded electric socket extending outwardly from a second end of said other housing and connectable to the male fitting of a similar accessory device whereby a plurality of such devices may be releasably coupled together;

electrically conductive interconnections within said inner and outer telescoping housings extending between said fitting and said socket, said interconnections comprising a first pair of rectangular metallic bars affixed at one end in a cantilever manner to an insulated support adjacent said fitting, said first bars having free ends and extending in parallel relation within one of said housings, and a second pair of rectangular metallic bars affixed at one end in a cantilever manner to an insulated support adjacent said receptacle, said second bars having free ends and extending in parallel relation within the other of said housings, said first bars each having their free end portions formed into a sleeve for sliding contact with one of said second bars, said electrical interconnection being prevented from losing contact with each other during rotation of said device due to said cooperation of said lips and grooves.

2. The accessory device in accordance with claim 1, wherein said sleeve includes a U-shaped portion for receiving and contacting the said second bars along three sides thereof and an inwardly directed horizontal ear connected to and extending from one side of the U-shaped portion for contacting the said second bars along the fourth side thereof.

* * * * *